US005553550A

United States Patent [19]

Doyle

[11] Patent Number: 5,553,550

[45] Date of Patent: Sep. 10, 1996

[54] TELESCOPING UPRIGHT

[75] Inventor: James E. Doyle, Grandville, Mich.

[73] Assignee: Suspa Incorporated, Grand Rapids, Mich.

[21] Appl. No.: 220,156

[22] Filed: Mar. 30, 1994

[51] Int. Cl.[6] ..... A47B 9/00

[52] U.S. Cl. ..... 108/144; 108/147; 248/188.5

[58] Field of Search ..... 108/144, 146, 108/148, 147; 248/188.5, 412, 413, 354.4

[56] References Cited

U.S. PATENT DOCUMENTS

| | | | |
|---|---|---|---|
| 2,547,296 | 4/1951 | White | 108/144 |
| 3,080,835 | 3/1963 | Giglielmi | 108/147 X |
| 3,347,511 | 10/1967 | Myers | 108/147 X |
| 4,667,605 | 5/1987 | Bastian | 108/144 |
| 4,673,155 | 6/1987 | Binder | 108/147 X |
| 4,711,184 | 12/1987 | Wallin | 108/144 |
| 4,981,085 | 1/1991 | Watt | 108/147 |
| 5,020,752 | 6/1991 | Rizzi | 248/162.1 |
| 5,022,327 | 6/1991 | Solomon | 108/147 |
| 5,285,733 | 2/1994 | Wailbel | 108/144 |
| 5,385,323 | 1/1995 | Garelick | 248/188.5 X |

*Primary Examiner*—Jose V. Chen
*Attorney, Agent, or Firm*—Price, Heneveld, Cooper, DeWitt and Litton

[57] ABSTRACT

An extruded aluminum upright support of a first, vertically elongated, extruded, integral, outer upright member and a second, vertically elongated, extruded, inner upright member telescopically arranged with each other, the outer member having a pair of spaced outer bearing channels, the inner member having a second pair of bearing channels; a first pair of bearings positioned in the first pair of bearing channels and extending laterally into the second pair of bearing channels; and a second pair of bearings positioned in the second pair of bearing channels and extending laterally into the first pair of bearing channels. The bearings are laterally expandable and contractible relative to bearing channels into which they extend. The bearings have two faces in the shape of a laterally oriented V at an obtuse angle to each other cooperable with wedge-shaped spacers each having a sloped face engaging one of the two faces, one of the spacers being axially fixed, and a threaded actuator engaging the other of the spacers whereby the threaded actuator can be employed to linearly move the spacers toward or away from each other to laterally expand or contract the bearings.

14 Claims, 7 Drawing Sheets

TELESCOPING UPRIGHT

BACKGROUND OF THE INVENTION

This invention relates to upright telescopic supports for work surfaces such as desks, table tops, etc., and more specifically to extruded aluminum telescopic uprights which are extensible and contractible with fluid cylinders.

Aluminum telescopic uprights of certain types are known for use to support work surfaces and the like. A typical such arrangement is depicted in FIG. 1, which is illustrative of prior art and also to explain the present invention, with the prior art upright itself being more specifically depicted in FIGS. 21–23 hereof. The conventional method of extending and contracting these uprights is with fluid cylinders enclosed in the uprights and actuated by hand operated, crank-type or motor driven fluid pumps. A common form of the upright involves a combination of three extruded aluminum members as in FIGS. 21–23. The two outer members 1, 2 snap together and cooperate with a one-piece inner member 3. These are retained in spaced relationship by a pair of U-shaped plastic bearings 4 therebetween. The inner member has a rectangular central portion with tabs, to receive the fluid cylinder bracket assembly.

Difficulties are experienced with these prior units because of the substantially large tolerances which occur when extruding aluminum. Consequently, the fit between the three units can be loose, i.e., sloppy, so that the work surface is loose and wobbly, or the fit can be overly tight so that the unit resists telescopic adjustment. A loose interfit creates significant potential problems with full or near full cylinder extension and relatively high cantilever loads. Further, the snap interfit between the two outer elements can be difficult to make and/or maintain. Also, the prior art does not offer an integral means for mounting a cross beam or stretcher support.

SUMMARY OF THE INVENTION

An object of this invention is to provide an aluminum telescopic upright support formed of only two extruded elements, providing controlled, excellent interfit therebetween such that relatively high cantilever loads can be supported without compromising structural integrity or telescopic sliding performance, i.e., with reduced wobbly or looseness characteristics, enabling easy insertion and removal of operating cylinders, and capable of mounting in either of two orientations 180° apart, i.e., invertible.

The novel apparatus has novel bearing assemblies formed of special bearings capable of adjustment for tolerance variation and providing stability and optimum sliding performance. The bearings are so arranged, located and oriented as to effect guide support throughout the entire stroke of the adjustment cylinders. The bearings are partly mounted on the outer element at one end for engagement with the inner element and partly mounted on the inner element at the other end for engagement with the outer element.

A T-slot connection feature enables a stabilizing cross beam or stretcher to be mounted for lateral stability, such extending between two of the uprights. These slots can also be used for mounting supports to a table frame.

These and several other objects, advantages and features of the invention will become apparent from studying the following specification in conjunction with the drawings.

DESCRIPTION OF THE PREFERRED EMBODIMENT

Figure 1:
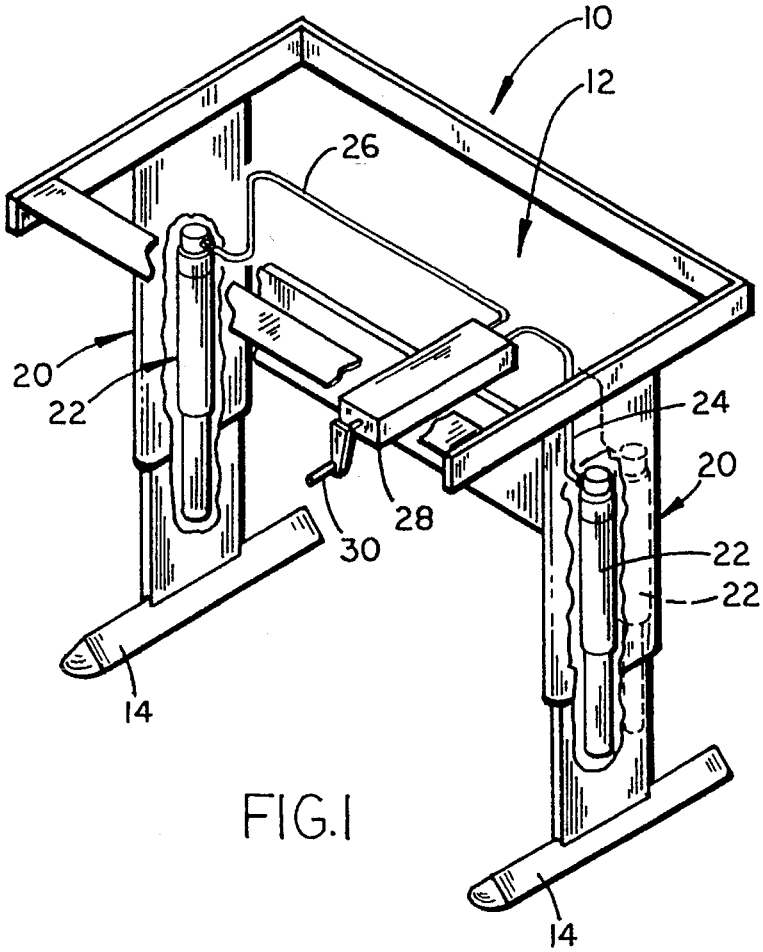
FIG. 1 is a perspective view of a work surface mounted on two upright supports.

Referring now specifically to the drawings, the work table assembly 10 depicted in FIG. 1 is representative of the environment for the invention. This structure includes a work surface 12 generally horizontal in orientation, a pair of mounting feet 14 forming a base, a pair of upright supports 20, each of which includes one or two extendible fluid cylinders 22, these fluid cylinders being connected in conventional manner through fluid lines 24 and 26 to a manually operable pump 28 having a manual crank or motor 30 for operation thereof. FIG. 1 shows one cylinder per upright, with the use of two cylinders per upright being depicted in the right upright in phantom lines.

Figure 2:
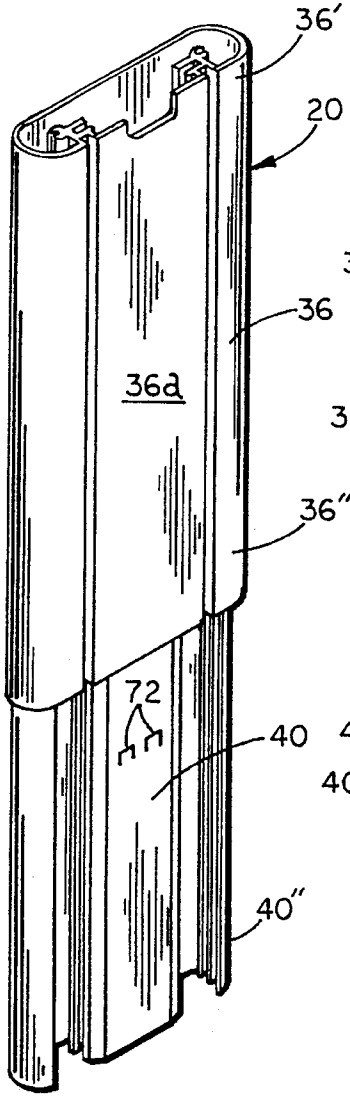
FIG. 2 is an expanded view of one of the novel upright supports shown telescopically extended.

Each of the supports 20 has a first, vertically elongated, extruded, outer upright member 36 having a first axial end 36' and a second axial end 36", here shown in the upper and lower positions respectively, and a second, vertically elongated, extruded inner upright member 40 having a first axial end 40' (inside of member 36 in FIG. 2) and a second axial end 40", here shown as the upper and lower ends respectively. These outer and inner elongated vertical members are telescopically arranged with each other to allow the first axial ends, i.e., upper, of both to correlate with each other and the second axial ends, i.e., lower, of both to correlate with each other. The two components are telescopically extensible and contractible to raise and lower the work surface 12 or other supported element relative to the base 14.

Figure 4:
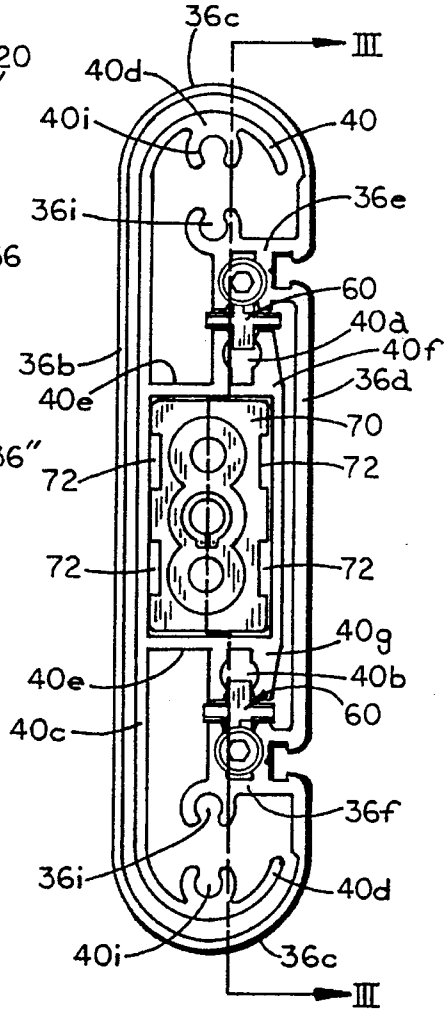
FIG. 4 is a bottom end view of the structure in FIG. 2.

The uprights can be mounted with the outer member at the top, attached to the work surface, and the inner member at the bottom, attached to the foot or base. Alternatively, the outer member can be attached at the bottom and the inner member at the top. The unit is invertible as desired. In the embodiment as depicted, the outer member is shown at the top, having its upper end mounted to the bottom of the work surface 12, and the inner member is at the bottom, having its bottom end attached to the foot or base. 14. Attachment of work surface 12 to the outer member is by any suitable fastener device such as threaded bolts 16 (FIG. 3) shown extending through orifices in the work surface and into integral receiving sockets **36*i* (FIG. 4) on the protrusions 36*e* and 36*f*. Similarly, base 14 is shown attached to inner member 40 at its lower end by threaded fasteners 18 (FIG. 3) extending through openings in base 14 and into integral sockets 40*i*** (FIG. 4).

Outer member 36 comprises a continuous, hollow extrusion enclosing a space inside its spaced, parallel walls **36*a* and 36*b* which are integrally connected by a pair of curved arcuate ends 36*c*. The inner wall 36*a*, i.e., "inner" relative to the assembly 10, has elongated spaced protrusions 36*e* and 36*f* extending into the hollow interior of the outer member and defining a first pair of outer, spaced bearing channels 36*g* and 36*h*** respectively.

Positioned within bearing channels **36*g* and 36*h* is a pair of respective bearings 50 retained positioned adjacent the upper end of the lower, inner upright member 40'**, and forming a first bearing subassembly.

Figure 3:
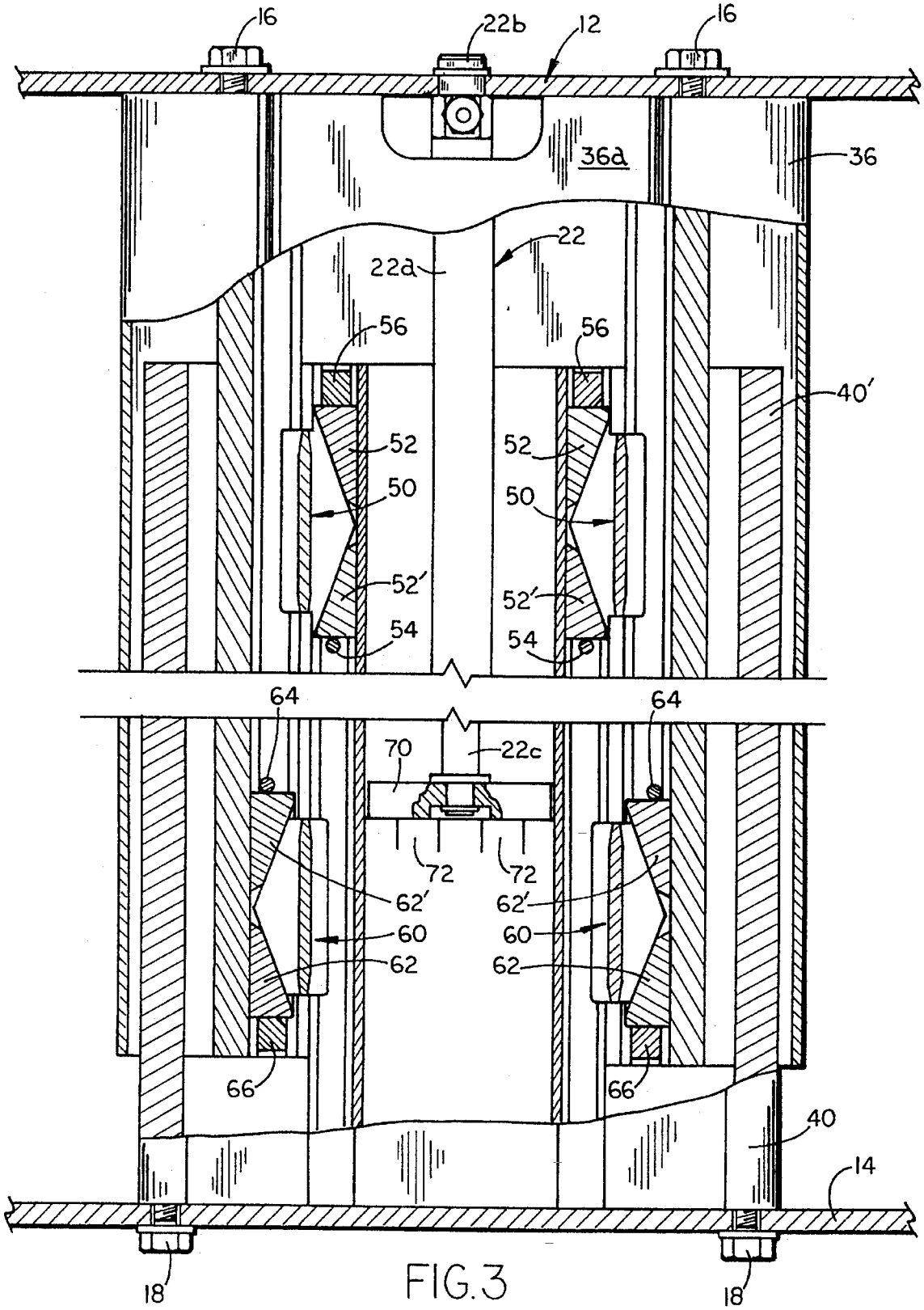
FIG. 3 is a sectional view taken on plane III—III of FIG. 4.
Figure 6:
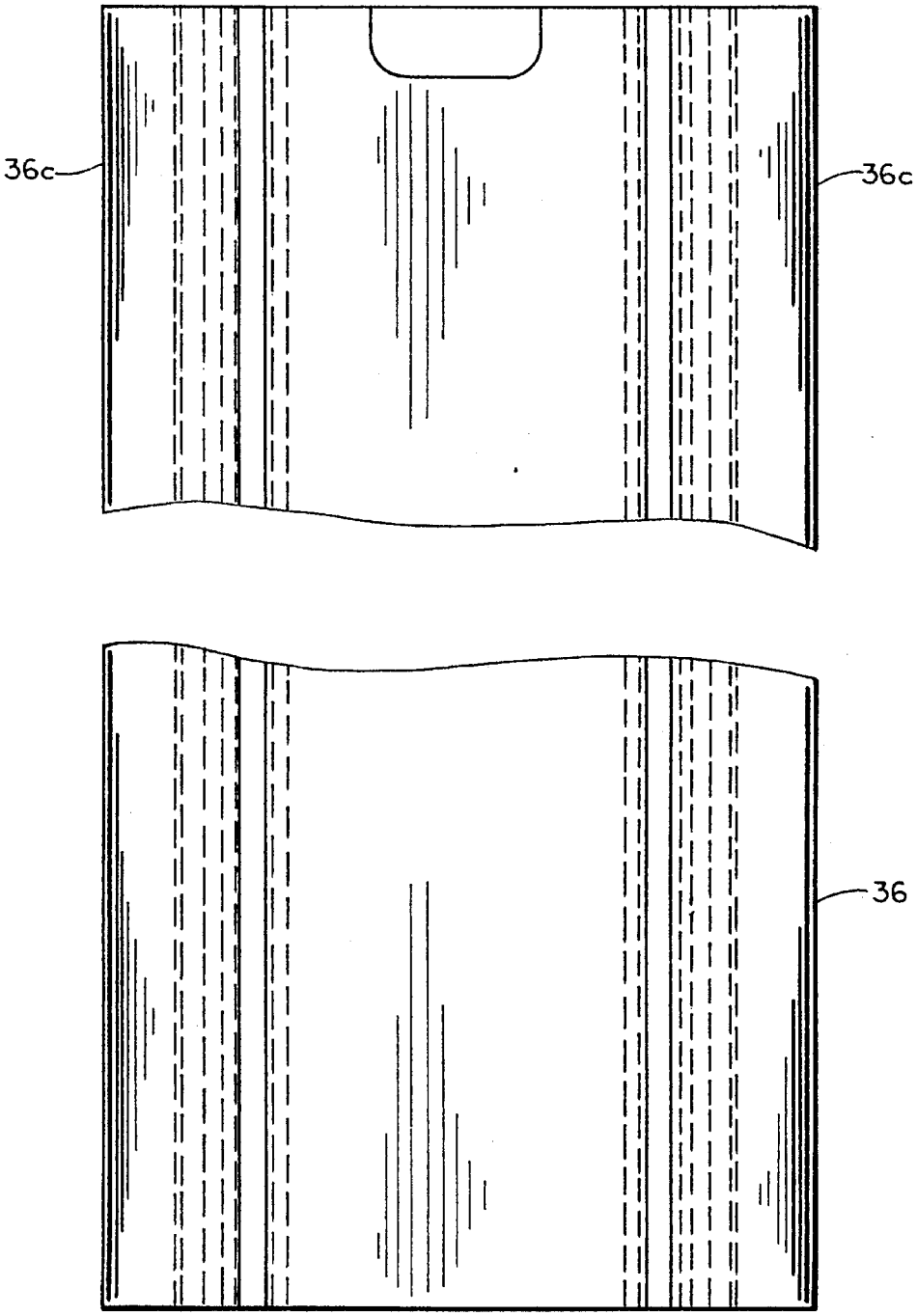
FIG. 6 is an elevational view of the outer telescopic member of the invention.
Figure 7:
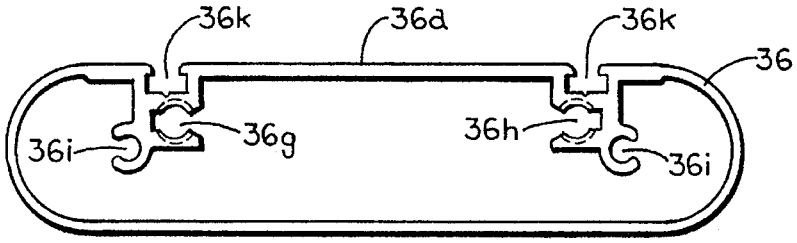
FIG. 7 is an end view of the outer member in FIG. 6.
Figure 9:
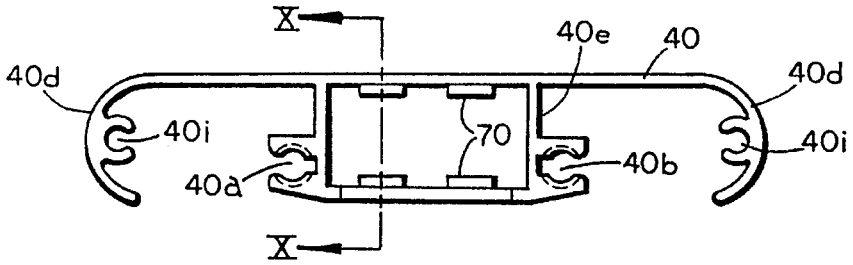
FIG. 9 is an end view of the inner member in FIG. 8.
Figure 8:
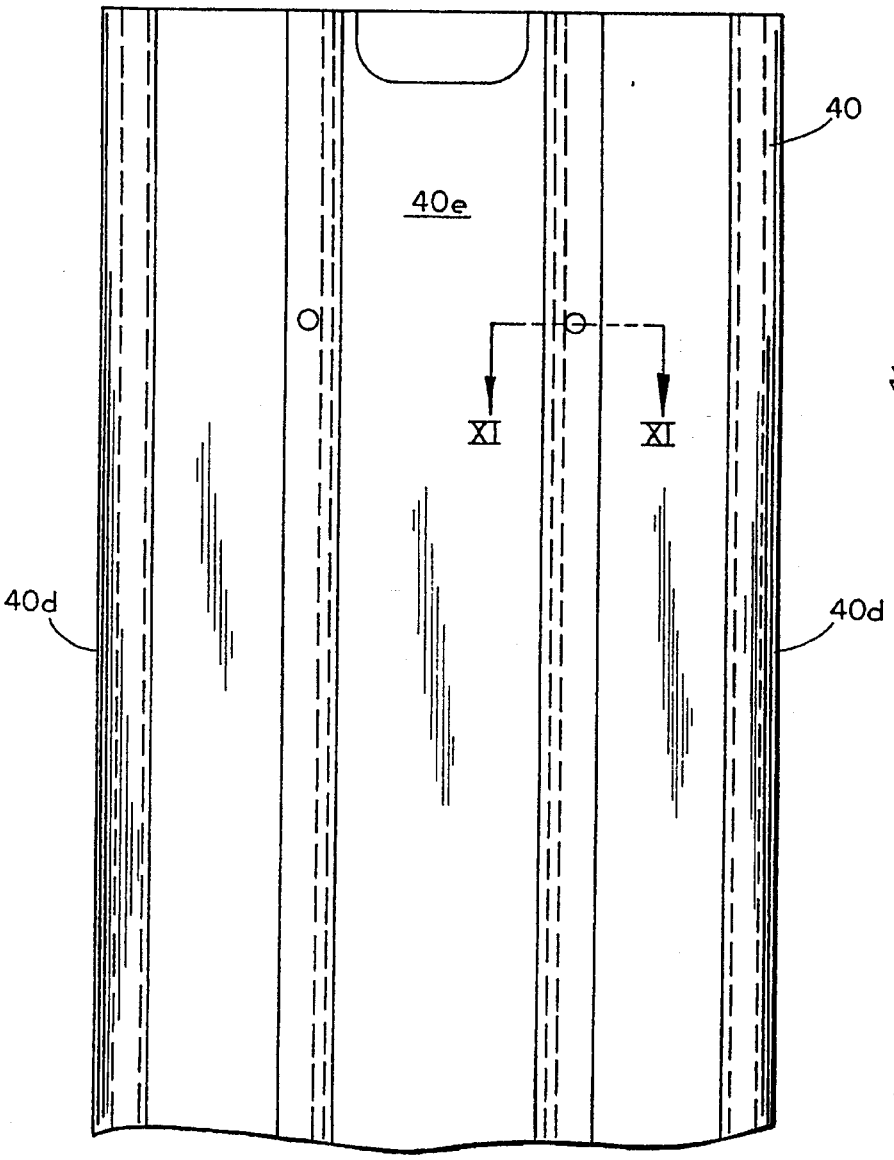
FIG. 8 is an elevational view of the inner telescopic member of the invention.
Figure 11:
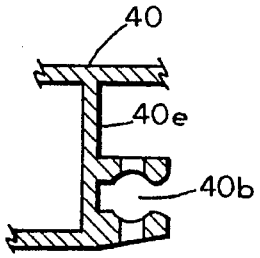
FIG. 11 is a fragmentary, enlarged, sectional view taken on plane XI—XI of FIG. 8.
Figure 10:
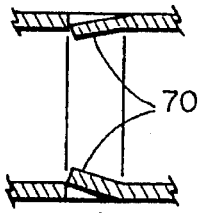
FIG. 10 is an enlarged, fragmentary, sectional view taken on plane X—X of FIG. 9.
Figure 17:
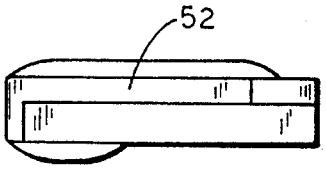
FIG. 17 is a view taken on plane XVII—XVII of FIG. 15.
Figure 15:
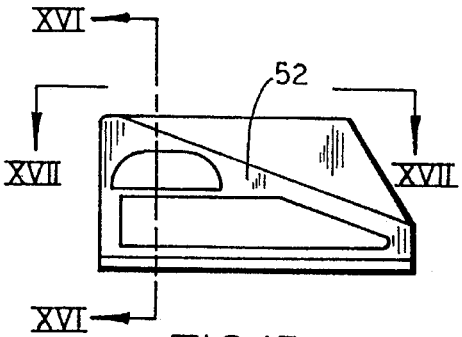
FIG. 15 is an elevational view of a one-faced spacer wedge, of which two are employed with this invention.
Figure 16:
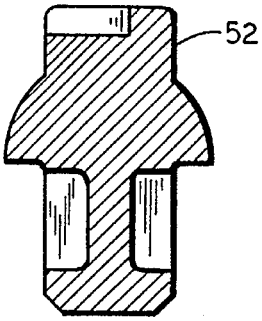
FIG. 16 is a sectional view of the spacer in FIG. 15, taken on plane XVI—XVI.
Figure 13:
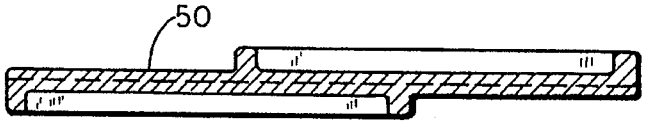
FIG. 13 is a sectional view taken on plane XIII—XIII of FIG. 12.
Figure 12:
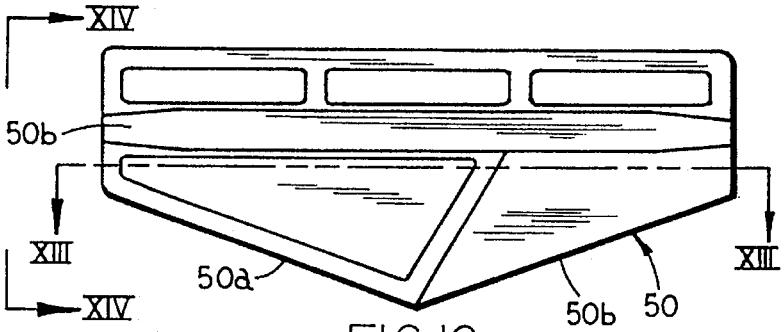
FIG. 12 is an elevational view of the two-faced guide bearing employed in this invention.
Figure 19:
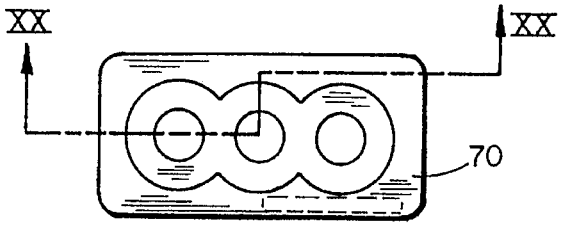
FIG. 19 is a top view of the mount bracket in FIG. 18.
Figure 20:
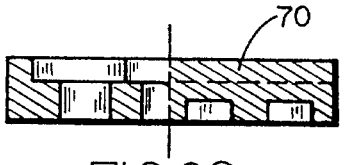
FIG. 20 is a sectional view token on the offset planes XX—XX of FIG. 19.
Figure 18:
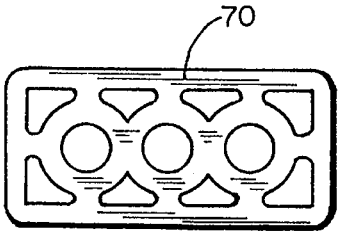
FIG. 18 is a bottom view of a cylinder mount bracket for the fluid cylinder.
Figure 23:
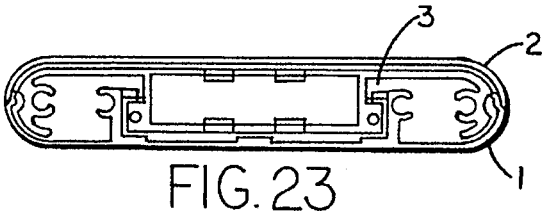
FIG. 23 (PRIOR ART)
FIG. 23 is a top end view of the upright support in FIG. 21.
Figure 21:
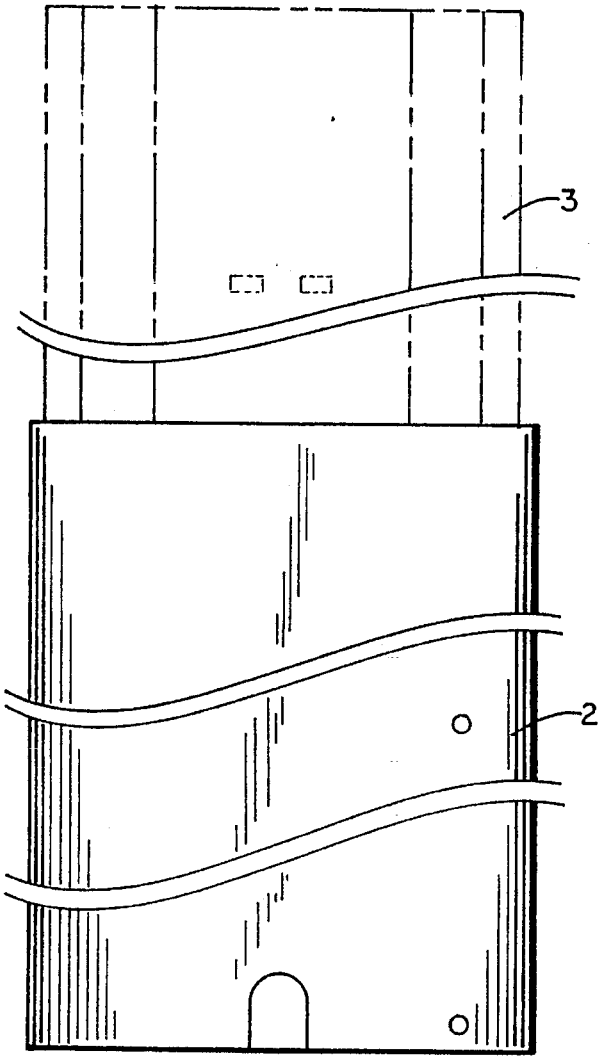
FIG. 21 (PRIOR ART)
FIG. 21 is an elevational view of a prior art upright support.
Figure 22:
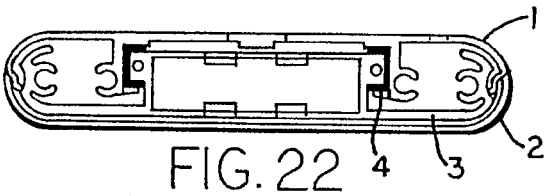
FIG. 22 (PRIOR ART)
FIG. 22 is an end view of the upright support in FIG. 21.

More specifically, the first pair of bearings 50 is supported in bearing channels **36*g* and 36*h* while projecting laterally into a pair of bearing channels 40*a* and 40*b* of inner element 40. Inner element 40 has a wall 46*c* which extends adjacent wall 36*b* of outer element 36, and has a pair of curved ends 40*d* adjacent the curved ends 36*c* of the outer element, and defining the integral bolt receiving sockets 40*i*. Inner element 40 has a central extension 40*e* which is shown as generally rectangular in configuration and is hollow to receive cylinder mounting brackets in a manner to be described hereinafter. Extending from opposite sides of this extension is a pair of elongated spaced projections 40*f* and 40*g* (FIG. 4) which define a second pair of spaced bearing channels 40*a* and 40*b*. These bearing channels are immediately adjacent the bearing channels 36*g* and 36*h* of the outer member. Within bearing channels 40*a* and 40*b* is a second bearing assembly formed of a pair of bearings 60 which extend into bearing channels 36*g* and 36*h* of outer member 36. Bearings 60 are retained at the lower end of outer, upper element 36 (FIG. 3). The location of one pair of bearings at the upper end of the lower element and at the bottom end of the upper element of the telescopic pair of uprights is found to provide excellent support, particularly with the laterally expandable and contractible nature of the bearing assemblies as described hereinafter. Bearings 50 and 60 are alike but extend in opposite directions and are located in the opposite bearing channels. The construction of both is shown in more detail in FIGS. 12, 13 and 14. Therefore, only bearing 50** will be described in detail in those figures.

Figure 14:
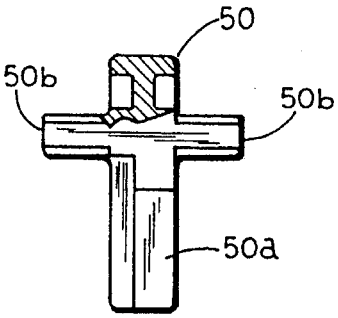
FIG. 14 is an end elevational view, partially sectioned, taken on plane XIV—XIV of FIG. 12.

Each of the bearings 50 (or 60) has a pair of oppositely extending flanges (see **50*c* in FIG. 14). These flanges separate the bearing tracks (see FIGS. 4 and 5) of the outer and inner elements 36 and 40. Each also has a laterally oriented, two-faced element, with the two lateral faces in the shape of a laterally oriented V at a large obtuse angle to each other. These faces engage a pair of wedge-shaped spacers located in the bearing channel of the other upright element. Therefore, bearings 50 have the two faces 50*a* and 50*b* at an obtuse angle to each other and laterally oriented so as to engage the cooperative, laterally oriented, tapered faces of a pair of wedge-shaped, upper and lower spacers 52 and 52' respectively. These two spacers have their tapered surfaces axially oriented generally toward each other but with opposite slopes. They are vertically trapped between fixed stops 54 beneath the lower ends of the respective spacers 52' and secured in the bearing channels 40*a* and 40*b* of the inner element, and a pair of axially movable threaded bolts or set screws 56 engaging the upper ends of upper spacers 52 and threaded into the bearing channels 40*a* and 40*b* of the inner element. Rotation of set screws 56 in one direction or the other causes upper spacers 52 to move downwardly toward, or upwardly away from, lower spacers 52', thereby sliding bearings 50 laterally outwardly to expand the bearing assembly and thereby tighten the interrelationship between the upper end 40' of the inner member 40 and the cooperating portion of the outer member 36, or alternatively retracting bearings 50** laterally inwardly to contract the bearing assembly and thereby loosen the interrelationship.

Similarly, at the lower end of outer member, bearings 60 have a pair of faces in a laterally oriented, V-shaped relationship, at an obtuse angle to each other, projecting laterally outwardly into engagement with respective pairs of lower spacers 62 and upper spacers 62'. Upper spacers 62' abut against fixed anchor pins or stops 64 in the outer bearing channels **36*g* and 36*h*, while lower spacers 62 engage a pair of set screws 66. Thus, rotation of set screws 66 will cause wedge members or spacers 62 and 62' to move toward or away from each other, thereby causing bearings 60** to move laterally outwardly or inwardly, to expand or contract the bearing subassemblies at the lower end of the outer element. Therefore, any sloppiness due to tolerance variations of the extrusions can be accommodated by adjusting the bearing subassemblies at the top and at the bottom, to eliminate slop yet allow effective telescopic sliding between the components, and maximize load support without compromising structural integrity or telescopic sliding performance.

Figure 5:
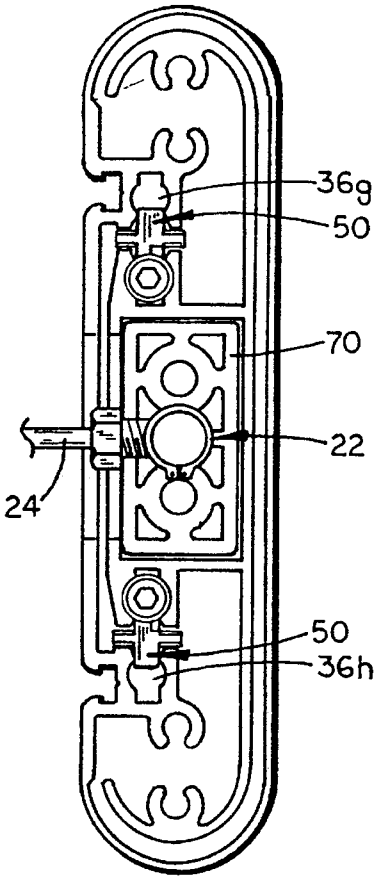
FIG. 5 is a top end view of the structure in FIG. 2.

This telescopic movement is achieved by the fluid cylinders 22 which, in conventional fashion, include an outer cylindrical member **22*a* having its upper end anchored by retaining ring 22*b* to support or work surface 12 and having a piston rod 22*c* extending from its lower end and attached to a piston (not shown) in cylinder 22*a*. The lower end of the piston rod in this embodiment is attached to bracket 70 which is preferably generally rectangular in configuration as shown in FIGS. 3, 4 and 5. FIG. 4 is a view from the bottom of the structure while FIG. 5 shows it from the top. Bracket 70 is supported on a plurality, here four, of conventional tabs 72 which are struck out of the opposite walls of the rectangular extension 40*e*, to extend into the open space thereof (FIGS. 2, 3 and 4) beneath the lower surface of bracket 70. Hence, by supplying fluid to or taking fluid from cylinder 22 through fluid lines 24 and 26 in FIGS. 1 and 5, the fluid and piston assembly will extend or retract to thereby lift or lower work surface 12. As noted relative to FIG. 1, two cylinders 20 and 20'** can be incorporated into each upright, rather than just one, depending for example on the load to be lifted and lowered.

The inside wall **36*a* of outer element 36 also preferably includes a pair of T-slots 36*k* so that a cross beam or stretcher can be extended between the two uprights of the final assembly, for stability and strength. Specifically, in FIG. 1 there is depicted an upper stretcher or beam 21 attached at its opposite ends to the two uprights. FIG. 1 also depicts a lower stretcher on beam 23 extending between and attached to the feet 14**. Either or both of these beams can be used selectively.

Figure 24:
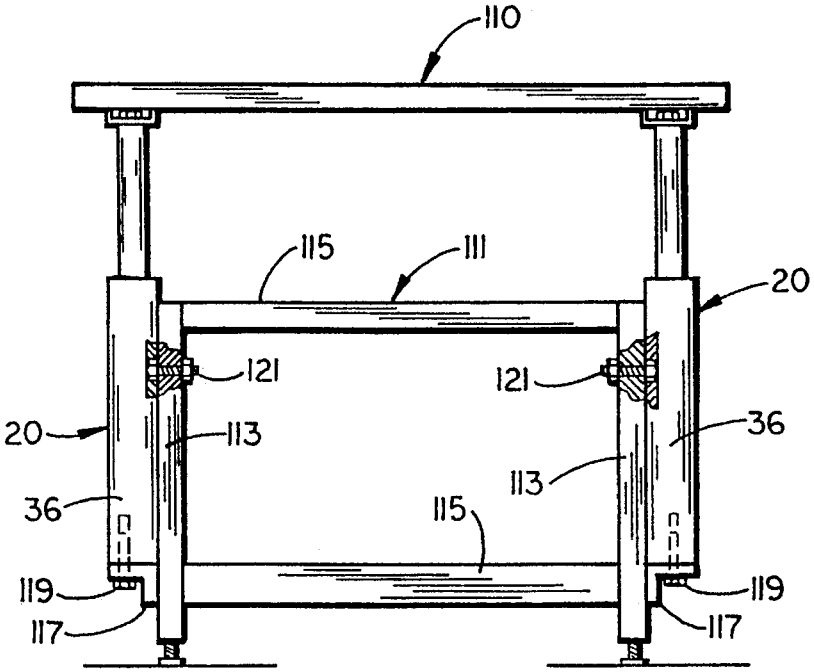
FIG. 24 is a front elevational view of a second embodiment which incorporates a structural frame in the assembly.

In FIG. 24 is depicted an embodiment wherein the assembly 110 incorporates a separate structural framework 111, so that the uprights 20 do not form the only support. This framework is shown formed of interconnected, spaced, vertical leg components 113 and spaced horizontal components 115. Legs 113 are supported on feet 114 so that the uprights 20 are supported by these feet 114. The outer members 36 of uprights 20 are shown mounted on angle iron supports 117 with fasteners 119 that attach to the bottom ends of outer members 36. Members 36 are also attached to legs 113 by fasteners 121 secured in the T-slots of uprights 20. Inner members 40 have the upper ends thereof attached to the work surface 112. The junction of the uprights is like that previously described relative to the first embodiment. Therefore, the fluid cylinders and pump for such are not depicted.

In addition to the advantages set forth previously herein, those having skill in this field, upon studying this disclosure, will readily be able to make certain minor variations to suit particular installations, but still in accordance with this invention. Therefore, the invention is not intended to be limited to the preferred embodiment set forth herein as illustrative of the invention, but only by the scope of the appended claims and the reasonably equivalent structures to those defined therein.

The embodiments of the invention in which an exclusive property or privilege is claimed are defined as follows.

1. An upright support comprising:

a first, vertically elongated, extruded, integral, outer upright member having a first axial end and a second axial end;

a second, vertically elongated, extruded, inner upright member having a first axial end and a second axial end;

said first and second members being telescopically arranged with each other to allow said first axial ends to correlate with each other and said second axial ends to correlate with each other;

said outer member in cross section having a pair of spaced side walls, and a pair of spaced end walls integral with said side walls to define a hollow interior receiving said inner member;

said outer member having a pair of elongated, spaced protrusions extending into said hollow interior and defining a first pair of spaced outer bearing channels;

said inner member having a pair of elongated, spaced projections extending adjacent said pair of protrusions and defining a second pair of bearing channels;

a first pair of bearings positioned in said first pair of bearing channels and extending laterally into said second pair of bearing channels;

said first pair of bearings being adjacent said second axial end of said outer extruded member;

a second pair of bearings positioned in said second pair of bearing channels and extending laterally into said first pair of bearing channels; and said second pair of bearings being at said first axial end of said inner member.

2. The upright support in claim 1 wherein said first pair of bearings is laterally expandable and contractible relative to said second pair of bearing channels, and said second pair of bearings is laterally expandable and contractible relative to said first pair of bearing channels; and first expansion and contraction actuators operably associated with said first pair of bearings, and second expansion and contraction actuators operably associated with said second pair of bearings.

3. The upright support in claim 2 wherein said first and second pairs of bearings engage wedging elements enabling said bearings and wedging elements to be laterally expandable and contractible, and wherein said actuators are axially movable threaded members.

4. The upright support in claim 3 wherein said threaded members are movable set screws engaging said wedging elements.

5. The upright support in claim 3 wherein said bearings comprise a first two-faced element having the two faces in the shape of a laterally oriented V at an obtuse angle to each other, and said wedging elements comprise a pair of wedge-shaped spacers each having a sloped face engaging one of said two faces, one of said spacers being axially fixed, and a threaded actuator engaging the other of said spacers whereby said threaded actuator can be employed to linearly move said other spacer toward or away from said one spacer, and thereby laterally move said two-faced element to laterally expand or contract said bearings.

6. The upright support in claim 1 wherein said first and second extruded elements have fastener receiving means on the axial ends thereof for mounting said upright to a base on one axial end and to a work surface on the other axial end.

7. The upright support in claim 1 wherein said first and second pairs of bearings have pairs of oppositely extending flanges positioned between said first and second pairs of bearing channels.

8. An upright support comprising:

a first, vertically elongated, outer upright member;

a second, vertically elongated, inner upright member;

said first and second members being telescopically arranged with each other;

bearings positioned between said first and second elements, said bearings being laterally expandable and contractible;

expansion and contraction actuators operably associated with said bearings, said bearings each including a pair of vertically spaced spacers having oppositely sloped faces oriented toward each other;

each of said bearings including a wedging element between and engaging said sloped faces to cause said bearings to be laterally expandable and contractible with axial movement of one of said spacers; and said actuators comprising axially movable threaded members each engaging one of said spacers to cause axial movement of said one spacer.

9. The upright support in claim 8 wherein said wedging elements each comprise a two-faced element having two faces in the shape of a laterally oriented V, and said spacers each having a sloped face engaging one of said two faces, one of said spacers being axially fixed, and said threaded actuator engaging the other of said spacers, whereby said threaded actuator can be employed to axially move said other spacer and thereby laterally move said two-faced element to laterally expand or contract said bearings.

10. A vertically movable work surface assembly comprising:

a work surface;

a pair of spaced, upright, telescopic supports beneath said work surface;

extensible-contractible fluid cylinders for extending and contracting said upright supports, and fluid supply means for operating said fluid cylinders;

each said upright support comprising a first, vertically elongated, extruded, integral, outer upright member having a first axial end and a second axial end and a second, vertically elongated, extruded, inner upright member having a first axial end and a second axial end;

said first and second members being telescopically arranged with each other to allow said first axial ends to correlate with each other and said second axial ends to correlate with each other;

said outer member in cross section having a pair of spaced side walls, and a pair of spaced end walls integral with said side walls to define a hollow interior receiving said inner member;

said outer member having a pair of elongated, spaced protrusions extending into said hollow interior and defining a first pair of spaced outer bearing channels;

said inner member having a pair of elongated, spaced projections extending adjacent said pair of protrusions and defining a second pair of bearing channels;

a first pair of bearings positioned in said first pair of bearing channels and extending laterally into said second pair of bearing channels;

said first pair of bearings being adjacent said second axial end of said outer extruded member;

a second pair of bearings positioned in said second pair of bearing channels and extending laterally into said first pair of bearing channels; and said second pair of bearings being at said first axial end of said inner member.

11. The assembly in claim 10 wherein said first pair of bearings is laterally expandable and contractible relative to said second pair of bearing channels, and said second pair of bearings is laterally expandable and contractible relative to said first pair of bearing channels; and first expansion and contraction actuators operably associated with said first pair of bearings, and second expansion and contraction actuators operably associated with said second pair of bearings.

12. The assembly in claim 11 wherein said first and second pairs of bearings engage wedging elements enabling said bearings and wedging elements to be laterally expandable and contractible, and wherein said actuators are threaded members.

13. The assembly in claim 12 wherein said bearings comprise a first two-faced element having the two faces in the shape of a laterally oriented V at an obtuse angle to each other, and said wedging elements comprise a pair of wedge-shaped spacers each having a sloped face engaging one of said two faces, one of said spacers being axially fixed, and a threaded actuator engaging the other of said spacers whereby said threaded actuator can be employed to linearly move said other spacer toward or away from said one spacer, and thereby laterally move said two-faced element to laterally expand or contract said bearings.

14. The assembly in claim 12 wherein said threaded members are set screws engaging said wedging elements.

* * * * *